US006039768A

United States Patent [19]

Ouziel

[11] Patent Number: 6,039,768

[45] Date of Patent: Mar. 21, 2000

[54] PROCESS FOR THE TREATMENT OF DYED CELLULOSIC FIBER MATERIAL

[75] Inventor: Philippe Ouziel, Altkirch, France

[73] Assignee: Ciba Specialty Chemicals Corporation, Tarrytown, N.Y.

[21] Appl. No.: 08/870,626

[22] Filed: Jun. 6, 1997

[30] Foreign Application Priority Data

Jun. 11, 1996 [CH] Switzerland ..... 1458/96

[51] Int. Cl.[7] ..... D06P 1/52; D06P 1/56; D06P 3/66

[52] U.S. Cl. ..... 8/543; 8/552; 8/553; 8/554; 8/918

[58] Field of Search ..... 8/549, 552, 553, 8/555, 918, 543

[56] References Cited

U.S. PATENT DOCUMENTS

| | | | |
|---|---|---|---|
| 2,861,863 | 11/1958 | Schuster et al. | 8/74 |
| 5,002,587 | 3/1991 | Berendt . | |
| 5,399,616 | 3/1995 | Kuhn et al. . | |
| 5,490,866 | 2/1996 | Guth . | |
| 5,653,772 | 8/1997 | Mori et al. . | |

FOREIGN PATENT DOCUMENTS

| | | |
|---|---|---|
| 963057 | 5/1957 | Germany . |
| 1469618 | 12/1968 | Germany . |
| 19723661 | 12/1997 | Germany . |
| 735557 | 8/1955 | United Kingdom . |
| 1067102 | 5/1967 | United Kingdom . |

OTHER PUBLICATIONS

Chem. Abst. 128: 76551n (for DE 19723661) Dec. 1997.
Chem. Abst. vol. 53, 10784; (for DE 963057) May 1957.
Chem. Abst. 92:216699g Aug. 1978.
Derwent Abst. 83–13366K of JP 57 21 0083 Dec. 1982.
Derwent Abst. 1983: 406842 of JP 572 10083 Dec. 1982.

*Primary Examiner*—Margaret Einsmann
*Attorney, Agent, or Firm*—David R. Crichton

[57] ABSTRACT

A process is described for fixing reactive or substantive dyes on cellulosic fiber material, which process comprises treating the fiber before, during or after dyeing with a liquor comprising a homo- or copolymer containing repeating structures of formula (1a)

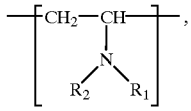

(1b)

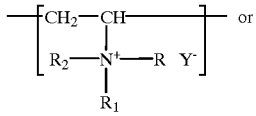

(2)

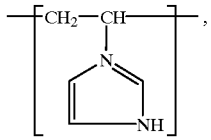

wherein the variables have the meanings claimed in the claims. The dyeings and prints so obtained are distinguished by improved fastness to wet treatments.

11 Claims, No Drawings

PROCESS FOR THE TREATMENT OF DYED CELLULOSIC FIBER MATERIAL

The present invention relates to a process for the treatment of dyed cellulosic fibre material, in particular for enhancing the fastness properties of said dyed cellulosic fibre material.

Dyeings and prints with reactive or substantive dyes often have unsatisfactory fastness to wet treatment, in particular to washing and water. The dye, which is bound to the surface of the cellulose, can be removed by repeated washing processes and deposited on an adjacent textile material which is washed in the same washing process. This shortcoming is usually met by following the dyeing process with an aftertreatment using a fixing agent based on fomaldehyde-containing products, homo- or copolymers based on (di)allylamine, or (poly)amine/dicyanodiamide condensates. However, the known fixing agents have disadvantages, e.g. unsatisfactory activity or an adverse influence on other fastness properties, such as fastness to light, or they are ecologically unsafe. Accordingly, there is a need for improved fixing agents not having these disadvantages for the treatment of cellulosic fibre material dyed with reactive or substantive dyes.

It has now been found that it is possible to enhance the fastness to wet treatments of reactive and substantive dyeings on cellulosic fibre material without adversely affecting other fastness properties by treating them with specific homo- or copolymers.

Accordingly, this invention relates to a process for fixing reactive or substantive dyes on cellulosic fibre material, which process comprises treating the fibre before, during or after dyeing with a liquor comprising a homo- or copolymer containing repeating structures of formula (1a)

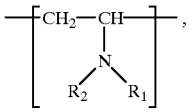

(1b)

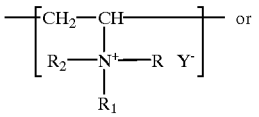

(2)

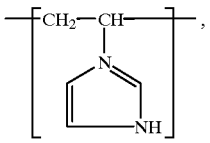

wherein $R_1$ is $C_1$–$C_{12}$alkyl which is unsubstituted or substituted by hydroxy, carboxy, cyano, carbamoyl, a radical —CONH—(alk)—T, N,N-di-$C_1$–$C_4$alkylcarbamoyl, aminophenylsulfonyl, amino or a radical —$NHR_3$, —$N(R_3)_2$, —$N(R_3)_3^+Y^-$, —COO—(alk)—T or

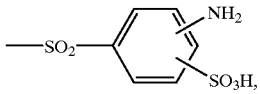

T is hydrogen or a radical —$NH_2$, —$NHR_3$, —$N(R_3)_2$, —$N(R_3)_3^+Y^-$, $R_3$ is $C_1$–$C_8$alkyl, $Y^-$ is an anion, (alk) is a straight-chain or branched $C_1$–$C_{10}$alkylene radical, and R and $R_2$ are each independently of the other hydrogen or benzyl or independently have one of the meanings given above for $R_1$.

The groups of formula (2) can each be present in the homo- or copolymers used according to this invention in the form of the free amine or in salt form, suitable counterions to the ammonium group being in principle all customary anions, typically the sulfate anion or, preferably, a halide anion, such as the bromide or chloride ion.

The alkyl radical $R_1$ is typically methyl, ethyl, n- or isopropyl, n-, iso-, sec- or tert-butyl, or straight-chain pentyl, hexyl, heptyl, octyl, nonyl, decyl, undecyl or dodecyl, and these alkyl radicals can each carry one or several of the above-mentioned substituents which are identical or different. $R_1$ is preferably a $C_1$–$C_6$alkyl radical which may be substituted as stated above, more preferably a $C_1$–$C_4$alkyl radical which may be substituted as stated above and, particularly preferably, a $C_2$–$C_4$alkyl radical which carries at least one of the above-mentioned substituents.

The alkyl radical $R_3$ is typically methyl, ethyl, n- or isopropyl, n-, iso-, sec- or tert-butyl, or straight-chain pentyl, hexyl, heptyl or octyl. $R_3$ is preferably $C_1$–$C_4$alkyl, particularly preferably methyl or ethyl and, very particularly preferably, methyl.

$Y^-$ can be any anion. $Y^-$ is preferably a halide anion, typically the bromide ion $Br^-$ or, preferably, the chloride ion $Cl^-$.

(alk) is typically methylene or straight-chain or branched ethylene, propylene, butylene, pentylene, hexylene, heptylene, octylene, nonylene or decylene. (alk) is preferably straight-chain or branched $C_1$–$C_6$alkylene, typically methylene, 1,1- or 1,2-ethylene, 1,2- or 1,3-propylene, or straight-chain or branched butylene, pentylene or hexylene, and particularly preferably, $C_1$–$C_4$alkylene.

T is typically hydrogen, or a radical —$NH_2$, —$NHR_3$, —$N(R_3)_2$, —$N(R_3)_3^+Y^-$, wherein $R_3$ and $Y^-$ each have the meanings and preferred meanings cited above. T is preferably hydrogen, amino, N-mono- or N,N-di-$C_1$–$C_2$alkylamino or a radical —$N(R_3)_3^+Y^-$, wherein $R_3$ is hydrogen, methyl or ethyl, and $Y^-$ is a halide anion. T is particularly preferably N,N-di-$C_1$–$C_2$alkylamino or a radical —$N(R_3)_3^+Y^-$, wherein $R_3$ is methyl or ethyl, and $Y^-$ is the bromide or chloride anion.

$R_1$ substituted by aminophenylsulfonyl is typically o- or m-aminophenylsulfonyl and, preferably, p-aminophenylsulfonyl.

$R_1$ is preferably a $C_1$–$C_6$alkyl radical which is unsubstituted or substituted by hydroxy, cyano, carbamoyl, a radical —CONH—(alk)—T, N,N-di-$C_1$–$C_4$alkylcarbamoyl, p-aminophenylsulfonyl, amino or a radical —$NHR_3$, —$N(R_3)_2$, —$N(R_3)_3^+Y^-$ or —COO—(alk)—T, wherein (alk) is $C_1$–$C_4$alkylene, $R_3$ is $C_1$–$C_4$alkyl, $Y^-$ is a halide anion and T is hydrogen, amino, N-mono- or N,N-di-$C_1$–$C_4$alkylamino, or a N,N,N-tri-$C_1$–$C_4$alkylammonium halide.

$R_1$ is preferably a $C_1$–$C_4$alkyl radical which is unsubstituted or substituted by hydroxy, cyano, amino, N-mono- or N,N-di-$C_1$–$C_2$alkylamino, N,N,N-tri-$C_1$–$C_2$alkylammonium halide or a radical —CONH—$(CH_2)_{1-3}$—$N(R_3)_2$ or —COO—$(CH_2)_{1-3}$—$N(R_3)_2$, wherein $R_3$ is methyl or ethyl.

Particularly preferred meanings of $R_1$ are $C_1$–$C_2$alkyl, preferably methyl, hydroxy-$C_1$–$C_2$alkyl, in particular 2-hydroxyethyl, cyano-$C_1$–$C_3$alkyl, preferably 2-cyanoethyl, N,N-di-$C_1$–$C_2$alkylamino-$C_1$–$C_3$alkyl, in particular 2-N,N-dimethylaminoethyl, or a radical of formula $$—CH_2—CH(OH)—(CH_2)_n—T, \quad (3a)$$

$$—CH_2—CH(R_4)—COO—(CH_2)_m—T, \quad (3b) \text{ or}$$

$$—CH_2—CH(R_4)—CONH—(CH_2)_m—T \quad (3c),$$

wherein $R_4$ is hydrogen or methyl, n is 1 or 2, and m is a number from 1 to 3, and T is N,N-di-$C_1$–$C_2$alkylamino or a radical —$N(R_3)_3^+Y^-$, wherein $R_3$ is methyl or ethyl, and $Y^-$ is the bromide or chloride anion.

If R and $R_2$ have one of the meanings cited above for $R_1$, then they independently have the above preferred meanings.

R and $R_2$ are each independently of the other preferably hydrogen or $C_1$–$C_4$alkyl, particularly preferably hydrogen, methyl or ethyl and, most preferably, hydrogen.

The homo- and copolymers containing repeating structures of the above formula (2) which are used as fixing agents can typically be prepared by polymerising N-vinylimidazole and optional further copolymerisable monomers in suitable manner and, where required, subsequently hydrolysing them.

The homo- and copolymers containing repeating structures of the above formulae (1a) and (1b) which are used as fixing agents can typically be prepared by polymerising N-vinylformamide or N-vinylacetamide and optional further copolymerisable monomers, subsequently hydrolysing them and then subjecting the free amino groups of the homo- or copolymer so obtained to an alkylation reaction using an alkyl halide $R_1$—X and, optionally, R—X' and $R_2$—X", wherein R, $R_1$ and $R_2$ each have the meanings cited above, and wherein X, X' and X" are each independently of one another a halide anion, preferably the bromide or chloride ion. Instead of carrying out the alkylation reaction with a suitable alkyl halide it is also possible to react the amino groups of the homo- or copolymer with a suitable epoxide or with an unsaturated compound containing a double bond.

The homo- and copolymers containing repeating structures of the above formulae (1a) and (1b) which are used as fixing agents, wherein R and $R_2$ are each hydrogen, may preferably also be prepared by polymerising a suitable vinyl formamido compound, conforming e.g. to formula

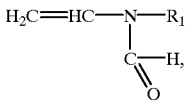

wherein $R_1$ has the meaning cited above, and then carrying out an acid or alkaline hydrolysis.

Where the polymers used according to this invention are copolymers, they may suitably be the following copolymerisable monomers: allylamine derivatives or diallylamine derivatives, typically diallylamine, N-methyldiallylamine, N-ethyldiallylamine, N,N-dimethyldiallylammonium chloride; monomers having carboxylic function, such as (meth) acrylic acid, maleic acid, fumaric acid, itaconic acid, mesaconic acid, citraconic acid, vinylacetic acid, vinyloxyacetic acid, vinylpropionic acid, crotonic acid, aconitic acid, allylacetic acid, allyloxyacetic acid, α,β-dimethylacrylic acid, allylmalonic acid, allyloxymalonic acid, methylenemalonic acid, 2-hydroxy(meth)acrylic acid, 2-halogeno(meth)acrylic acid, α-ethylacrylic acid, acrylamidoglycolic acid, glutaconic acid, β-carboxyethylacrylate, allyloxy-3-hydroxybutanic acid or allylsuccinic acid; or nitrogen-containing and non-ionic comonomers, typically N-vinylpyrrolidone, N-vinylformamide, N-vinylacetamide, N-vinyl-N-methylformamide, N-vinyl-N-methylacetamide, N-vinyl-N-ethylacetamide, N-vinylimidazole, N-vinyl-N-methylimidazole, N-vinylimidazoline, N-vinyl-2-methylimidazoline, N-vinylcaprolactam, vinyl acetate, vinyl propionate, vinyl butyrate, $C_1$–$C_{22}$alkyl vinyl ketone, $C_1$–$C_{22}$alkyl vinyl ether, olefins (ethylene, propylene, isobutene), 1,2-dimethoxyethylene, hydroxy-$C_2$–$C_4$alkyl (meth)acrylate, (meth)acrylic acid-$C_1$–$C_{22}$alkyl ester, (meth)acrolein, (meth)acrylonitrile, (meth)acrylamide, N-mono/N,N-di-$C_1$–$C_{10}$alkyl(meth)acrylamide, ($C_1$–$C_4$) alkoxy(meth)acrylate, or N,N-di-$C_1$–$C_2$alkylamino-$C_1$–$C_4$alkyl(meth)acrylate in the form of their salts or in quaternary form, suitable quaternising agents being e.g. dimethyl/ethyl sulfate, methyl/ethyl chloride, or benzyl chloride.

Preferred copolymerisable monomers in the fixing agents of this invention are allylamine derivatives or diallylamine derivatives, (meth)acrylic acid, maleinic acid, N-vinylpyrrolidone, N-vinylformamide, N-vinylacetamide, N-vinyl-N-methylformamide, N-vinyl-N-methylacetamide, N-vinyl-N-ethylacetamide, N-vinylimidazole, vinyl acetate, vinyl propionate, hydroxy-$C_2$–$C_4$alkyl(meth)acrylate, (meth)acrylic acid-$C_1$–$C_{22}$alkyl ester, acrylonitrile, methacrylonitrile, acrylamide, methacrylamide, N-mono/N,N-di-$C_1$–$C_{10}$alkyl(meth)acrylamide or N,N-di-$C_1$–$C_2$alkylamino-$C_2$–$C_4$alkyl(meth)acrylates in the form of their salts or in quaternised form, suitable quaternising agents being e.g. dimethyl/ethyl sulfate, methyl/ethyl chloride, or benzyl chloride.

Particularly preferred copolymerisable monomers in the fixing agents of this invention are acrylic acid, methacrylic acid, acrylonitrile, methacrylonitrile, N-vinylpyrrolidone, N-vinylformamide, N-vinylacetamide, N-vinylimidazole, vinyl acetate, acrylamide, methacrylamide, N-mono- or N,N-di-$C_1$–$C_4$alkyl(meth)acrylamide.

Preferred embodiments of the polymers used as fixing agents according to this invention are:

(i) homopolymers containing structural repeating units of the above formula (1a) or (1b), wherein the variables have the meanings and preferred meanings cited above;

(ii) copolymers obtainable by polymerising 80 to 20 mol %, preferably 60 to 40 mol %, of N-vinylimidazole and 20 to 80 mol %, preferably 40 to 60 mol %, of N-vinylformamide, where required with subsequent hydrolysis;

(iii) copolymers obtainable by polymerising 80 to 20 mol %, preferably 60 to 40 mol %, of N-vinylimidazole and 20 to 80 mol %, preferably 40 to 60 mol %, of a compound of formula

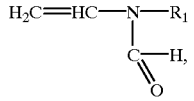

wherein $R_1$ has the meanings and preferred meanings cited above, where required with subsequent hydrolysis;

(iv) copolymers obtainable by polymerising 80 to 20 mol %, preferably 60 to 40 mol %, of N-vinylimidazole and 20 to 80 mol %, preferably 40 to 60 mol %, of N-vinylpyrrolidone;

(v) copolymers obtainable by polymerising N-vinylimidazole, N-vinylpyrrolidone and N-vinylformamide, where required with subsequent hydrolysis.

It is also possible to use mixtures of several of the homo- or copolymers cited above as fixing agents.

The homo- or copolymers used as fixing agents have an average molecular weight of e.g. <500,000 and, preferably, of 1,000 to 200,000.

The preparation of the polymers which are used as fixing agents is carried out in per se known manner, e.g. by ionically or, preferably, radically initiated polymerisation of the corresponding monomers e.g. in solution, suspension or emulsion, where required with subsequent hydrolysis. This polymerisation is preferably carried out in solution with a peroxide, persulfate or an azo compound, typically using potassium persulfate or azobis(2-amidinopropane) hydrochloride, as radical chain starter, which may be present e.g. in an amount of 0.005 to 10% by weight, based on the monomers used. If the polymerisation is followed by a hydrolysis step, said step is carried out under alkaline or, preferably, acid conditions. Acid hydrolysis predominantly gives polymers containing structural units of the above formula (1b) or (2) in salt form.

Independently of the liquor ratio, the homo- or copolymer used as fixing agent according to this invention is typically used in an amount of 0.05 to 10% by weight, preferably of 0.2 to 4% by weight and, particularly preferably, of 0.8 to 2.5% by weight of active content, based on the weight of the cellulosic fibre material.

The treatment of the cellulosic fibre material with the fixing agent can be carried out before, during or, preferably, after the dyeing. The process of this invention is preferably carried out by first dyeing the cellulosic fibre material in customary manner and then aftertreating it with a fresh aqueous liquor containing the fixing agent in the amount indicated above. The dyed cellulosic fibre material can then be dehydrated without any additional rinsing process and dried in customary manner.

The cellulosic fibre material may be, for example, regenerated cellulose or, preferably, natural cellulose, typically viscose staple, viscose silk, hemp, linen, jute or, preferably, cotton, and also fibre blends with synthetic fibres, such as cotton/polyamide blends or, preferably, cotton/polyester blends.

The textile goods may be used in any form of presentation, e.g. in the form of loose stack consisting completely or partially of native or regenerated cellulose, yarn, cheese, skein, wovens, knitgoods or felt.

Dyeings are carried out with substantive or reactive dyes, all customary direct and reactive dyes being suitable, such as those described in the Colour Index, 3. Edition (1971) and in the addenda thereto under the headings "Direct Dyes" and "Reactive Dyes".

Typical examples of said dyes are sulfo group-containing monoazo, polyazo, metal complexazo, anthraquinone, phthalocyanine, formazane or dioxazine dyes which, in the case of reactive dyes, carry at least one fibre-reactive group, e.g. a halotriazinyl group or a vinyl sulfonyl radical.

The dyeings of the cellulosic fibre material with the dye can be carried out in customary manner by the exhaust process or by a two-step process, for example by padding or printing and subsequent fixation.

Dyeing with substantive dyes is preferably carried out by an exhaust process at a neutral to acid pH.

Dyeing with reactive dyes is preferably carried out by an exhaust process or by padding with subsequent fixation of the dye on the fibre. Fixation can be effected in customary manner, typically with the action of heat by a steam process or by a thermosol process or, preferably, by a cold pad-batch method, the impregnated fibre material preferably being stored at room temperature.

The aftertreatment is preferably carried out by an exhaust process. The liquor ratio can be chosen from within a wide range and is typically from 1:4 to 1:100 and, preferably, from 1:5 to 1:40.

Special appliances are not required. It is possible to use, for example, the customary dyeing apparatus, e.g. open baths, winch becks, jiggers, or paddle jet or circulation apparatus.

Processing is conveniently carried out in the temperature range from e.g. 20 to 70° C. and, preferably, from 30 to 50° C. The treatment time may typically be from 20 to 60 minutes and, preferably, from 30 to 40 minutes. The pH of the liquor is usually in the range from 4 to 8 and, preferably, from 5 to 7.

In addition to the fixing agent, the liquor can contain other customary additives, typically electrolytes such as sodium chloride or sodium sulfate, dispersants, wetting agents and antifoams.

The novel process gives dyeings and prints of reactive or substantive dyes on cellulosic fibre material which have a substantially improved fastness to wet treatments, such as fastness to washing and water and, in particular, fastness to chlorine without, however, adversely affecting the colour yield, shade or the light fastness properties. The treated dyeings and prints furthermore do not show any stiffening.

The following Examples illustrate the invention in more detail.

PREPARATION EXAMPLES

Example 1

32.9 g of N-vinylimidazole, 24.9 g of N-vinylformamide and 100 g of deionised water are placed in a reactor and heated to about 80° C. A solution of 1.5 g of azobis (amidinopropane)hydrochloride in 10 g of water is then added dropwise over 90 minutes. This mixture is then allowed to afterpolymerise for 4 hours at 80° C., giving a polymer solution, the active substance of which substantially contains structural units of formulae

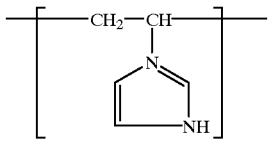

and

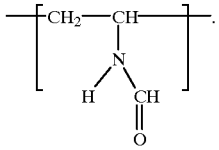

Example 2

The polymer solution obtained in accordance with Example 1 is diluted with water to a content of 20% by weight and is then heated with 40 g of 37% hydrochloric acid over 4 hours at 80° C., giving a viscous clear polymer solution. The polymer substantially contains units of formulae

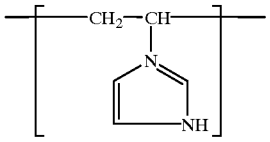

and

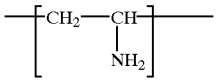

and is obtained as hydrochloride.

Example 3

25 g of vinylimidazole and 35 g of deionised water are placed in a reactor and heated to about 80° C. A solution of 0.5 g of azobis(amidinopropane)hydrochloride in 5 g of water is then added dropwise over 90 minutes. This mixture is then allowed to afterpolymerise for 4 hours at 80° C., giving a polymer solution, the active substance of which contains structural units of formula

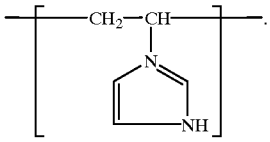

Example 4

22.3 g of vinylimidazole, 18.7 g of a 30% acrylamide solution and 134 g of deionised water are placed in a reactor and heated to about 80° C. A solution of 0.7 g of azobis (amidinopropane)hydrochloride in 10 g of water is then added dropwise over 90 minutes. This mixture is then allowed to afterpolymerise for 4 hours at 80° C., giving a polymer solution, the active substance of which substantially contains structural units of formulae

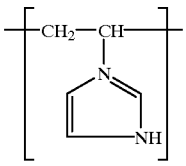

and

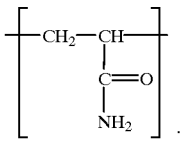

Example 5

20.8 g of vinylimidazole, 9.4 g of dimethylacrylamide and 110 g of deionised water are placed in a reactor and heated to about 75° C. A solution of 0.7 g of azobis (amidinopropane)hydrochloride in 10 g of water is then added dropwise over 90 minutes. The mixture is then allowed to afterpolymerise for 5 hours at 80° C., giving a polymer solution, the active substance of which substantially contains structural units of formulae

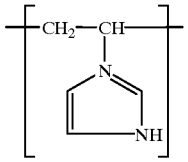

and

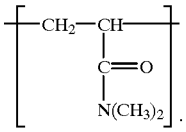

Examples 6 to 12

Example 1 is repeated, but replacing 24.9 g of N-vinylformamide in each case with the equimolar amount of one of the comonomers indicated in Table 1, column 2, to give polymer solutions, the active substances of which, in addition to the structural unit of the formula given below, substantially contain structural units that correspond to the formulae indicated in Table 1, column 3.

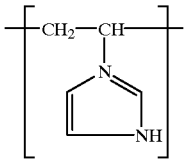

TABLE 1

| Example | Comonomer | Structural unit of formula |
|---|---|---|
| 6 | diallylamine | 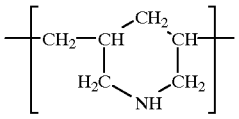 |
| 7 | N-vinylpyrrolidone | 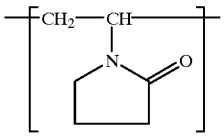 |
| 8 | N-vinyl-N-ethylacetamide | 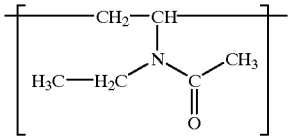 |
| 9 | vinyl acetate | 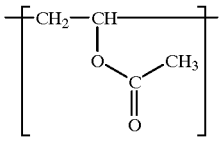 |
| 10 | methacrylamide | 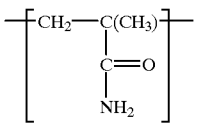 |

TABLE 1-continued

| Example | Comonomer | Structural unit of formula |
|---|---|---|
| 11 | N-methylmeth-acrylamide | 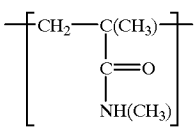 |
| 12 | N,N-dimethylmeth-acrylamide | 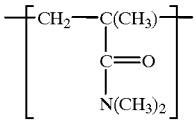 |

Example 13

25 g of 3-(N-vinylformamido)propionitrile and 90 g of water are placed in a reactor and heated to about 70° C. A solution of 0.22 g of azobis(amidinopropane)hydrochloride in 10 g of water is then added dropwise over 30 minutes at this temperature. This polymer solution is afterpolymerised for 5 hours at 70° C. The precipitated polymer is isolated, added to 100 g of water and 20 g of 37% hydrochloric acid and then hydrolysed for 5 hours at 95° C. The polymer, which substantially contains units of formula

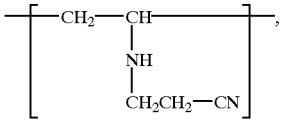

is precipitated in acetone, dried and and then dissolved in water.

Example 14

150 g of a polyvinylamine/HCl solution (degree of hydrolysis about 80%, prepared in general analogy to U.S. Pat. No. 4,421,602) are adjusted to pH 10 with sodium hydroxide solution. 0.5 g of benzyltrimethylammonium chloride is added and the reaction solution is then heated to 80° C. 23 g of 2-chloroethanol are then added dropwise over 3 hours while keeping the pH constant at about 9.5. The temperature is then kept for a further 3 hours at 80° C. Subsequently, the pH is adjusted to 3, the polymer is precipitated in acetone and dried. After adjusting the active content to 33%, a slightly viscous clear polymer solution is obtained, the active substance of which substantially contains structural units of formula

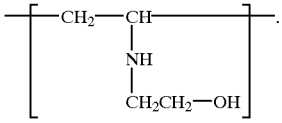

Example 15

150 g of a polyvinylamine/HCl solution (degree of hydrolysis about 80%, prepared in general analogy to U.S. Pat. No. 4,421,602) are adjusted to pH 10 with sodium hydroxide solution. 0.3 g of benzyltrimethylammonium chloride are added and the reaction solution is then heated to 80° C. 39.1 g of 1-chloro-2-N,N-dimethylaminoethane hydrochloride, dissolved in 50 g of water, are then added dropwise over 3 hours while keeping the pH constant at about 9.5. The temperature is then kept for another 3 hours at 80° C. Subsequently, the pH is adjusted to 3, the polymer is precipitated in acetone and dried. After adjusting the active content to 33%, a slightly viscous clear polymer solution is obtained, the active substance of which substantially contains structural units of formula

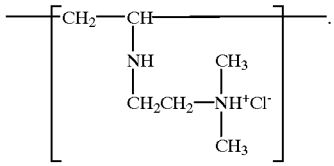

Example 16

20 g of 3-(N-vinylformamido)propionitrile, 8.5 g of acrylonitrile, 8.9 g of N-vinylpyrrolidone and 139 g of water are placed in a reactor and heated to 75° C. A solution of 0.9 g of azobis(amidinopropane)hydrochloride in 10 g of water is then added dropwise over 90 minutes at 75–80° C. After a 4 hour afterpolymerisation, 31.8 g of 37% hydrochloric acid are added and the mixture is heated for 5 hours to 95° C. The polymer is precipitated in ethanol and dried, and a 25% aqueous solution is then prepared, the active substance of which substantially contains units of formulae

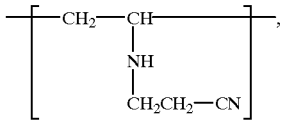

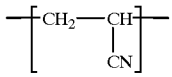

and

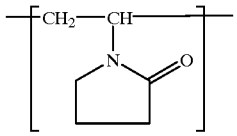

and which is obtained as hydrochloride.

Example 17

12.2 g of vinylimidazole, 8 g of acrylonitrile, 18.7 g of 3-(N-vinylformamido)propionitrile and 145 g of deionised water are placed in a reactor and heated to about 80° C. A solution of 0.95 g azobis(amidinopropane) hydrochloride in 10 g of water is then added dropwise over 90 minutes. After a 4 hour afterpolymerisation, 27.6 g of 37% hydrochloric acid are added and the mixture is heated for 4 hours to 80° C. The polymer is precipitated in acetone and dried, and a 30% aqueous solution is then prepared, the active substance of which substantially contains structural units of formulae

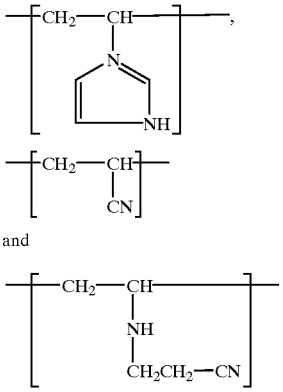

and which is obtained as hydrochloride.

Example 18

14.1 g of vinylimidazole, 16.7 g of vinylpyrrolidone, 35.7 g of a 30% acrylamide solution and 199 g of deionised water are placed in a reactor and heated to about 80° C. A solution of 1 g of azobis(amidinopropane)hydrochloride in 10 g of water is then added dropwise over 90 minutes. This mixture is then allowed to afterpolymerise for 4 hours at 80° C., giving a polymer solution, the active substance of which substantially contains structural units of formulae

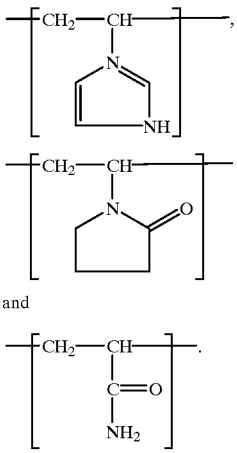

Example 19 a) 16.9 g of vinylimidazole, 20 g of vinylpyrrolidone, 22.3 g of 3-(N-vinylformamido)propionitrile and 226 g of deionised water are placed in a reactor and heated to about 80° C. A solution of 1.2 g of azobis(amidinopropane) hydrochloride in 10 g of water is then added dropwise over 90 minutes. This mixture is then allowed to afterpolymerise for 4 hours at 80° C., giving a polymer solution, the active substance of which substantially contains structural units of formulae

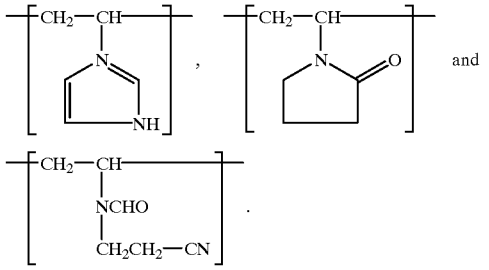

b) 148 g of the polymer solution obtained in accordance with Example 19a) and 17.8 g of 37% hydrochloric acid are heated for 4 hours to 80° C. The polymer is precipitated in acetone and dried, and a 30% aqueous solution is then prepared, the active substance of which substantially contains structural units formulae

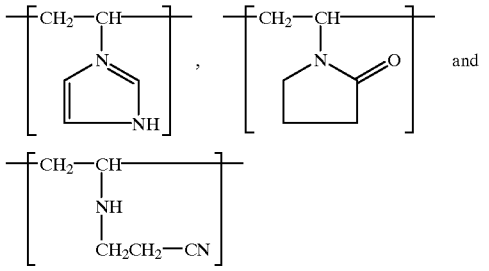

and which is obtained as hydrochloride.

Example 20

14.1 g of vinylimidazole, 16.7 g of vinylpyrrolidone, 25.7 g of 3-(N-vinylformamido)propionic acid ethyl ester and 215 g of deionised water are placed in a reactor and heated to about 80° C. A solution of 1 g of azobis(amidinopropane) hydrochloride in 10 g of water are then added dropwise over 90 minutes. After a 4 hour afterpolymerisation, 29.6 g of 37% hydrochloric acid are added and the mixture is heated for 4 hours to 80° C. The polymer is precipitated in acetone and dried, and a 20% aqueous solution is then prepared, the active substance of which substantially contains structural units of formulae

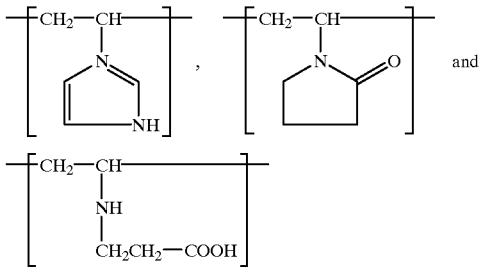

and which is obtained as hydrochloride.

Example 21

A solution of 9 g of acrylic acid in 88 g of deionised water is neutralised with about 16 g of a 30% sodium hydroxyde solution to pH 6.6. This acrylic acid solution, 11.8 g of vinylimidazole and 13.9 g of vinylpyrrolidone are then placed in a reactor and heated to about 80° C. A solution of 0.85 g of azobis(amidinopropane)hydrochloride in 10 g of water is then added dropwise over 90 minutes. This mixture is then allowed to afterpolymerise for 4 hours at 80° C., giving a polymer solution, the active substance of which substantially contains structural units of formulae

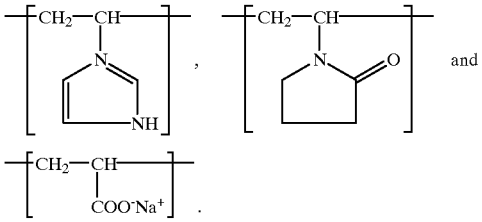

Example 22

100 g of a polyvinylamine hydrochloride solution (degree of hydrolysis about 80%, concentration about 18%, prepared in general analogy to U.S. Pat. No. 4,421,602) are placed in a reactor, adjusted to pH 10.5 by the addition of NaOH and heated to 75° C. A solution of 42.6 g of (3-chloro-2-hydroxypropyl)trimethylammonium chloride in 42.6 g of water is then added dropwise over 60 minutes at 75° C. while keeping the pH at about 10. This mixture is heated for about 4 hours to 75–80° C., the pH is adjusted to 2.0, the polymer is precipitated in ethanol and then dried. A 33% aqueous solution of the polymer is then prepared which substantially contains structural units of formula

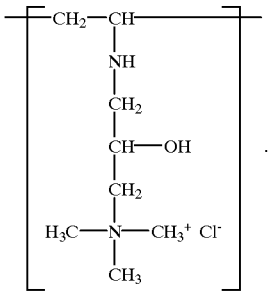

Example 23

100 g of a polyvinylamine/HCl solution (degree of hydrolysis about 80%, conc. about 18%, prepared in general analogy to U.S. Pat. No. 4,421,602) are adjusted to pH 10 with NaOH. 0.2 g of benzyltrimethylammonium chloride is then added and the reaction solution is heated to 80° C.

31 g of chloroethanol are added dropwise over 210 minutes while keeping the pH constant at about 9.5. This mixture is heated for another 3 hours to 80° C. The pH is adjusted to 2.5 and the polymer is then precipitated in acetone and dried. A 20% aqueous solution of the polymer is then prepared which substantially contains structural units of formula

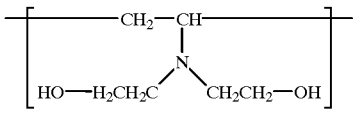

and which is obtained as hydrochloride.

Example 24

40 g of 3-(N-vinylformamido)propionitrile, 10.1 g of vinylimidazole and 82.1 g of water are heated to 80° C. A solution of 0.95 g of azobis(amidinopropane)hydrochloride in 10 g of water is then added dropwise over 90 minutes. After a 4 hour afterpolymerisation, 42.3 g of 37% HCl are added and the reaction mixture is heated for 5 hours to 95° C. The polymer is then precipitated in ethanol and dried. A 33% aqueous solution of the polymer is then prepared which substantially contains the structural units of formulae

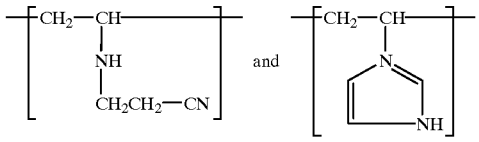

and which is obtained as hydrochloride.

Examples 25 to 29

Example 24 is repeated, but replacing 10.1 g of vinylimidazole in each case with the equimolar amount of one of the comonomers indicated in Table 2, column 2. Polymer solutions are obtained, the active substances of which are obtained as hydrochloride and which, in addition to the structural unit of the formula given below, substantially contain structural units which correspond to the formulae indicated in Table 2, column 3.

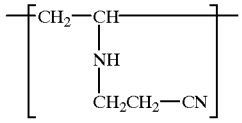

TABLE 2

| Example | Comonomer | Structural unit of formula |
|---|---|---|
| 25 | diallylamine | 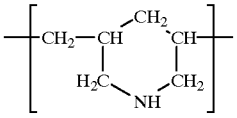 |
| 26 | acrylic acid | 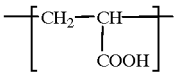 |
| 27 | vinyl pyrrolidone | 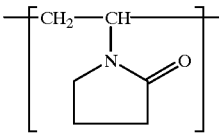 |
| 28 | N-vinyl-N-ethylacetamide | 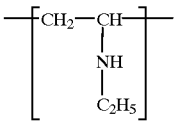 |

TABLE 2-continued

| Example | Comonomer | Structural unit of formula |
|---|---|---|
| 29 | acrylonitrile | 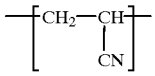 |

Example 30

12.8 g of vinyl formamide, 20 g of vinyl pyrrolidone, 16.9 g of vinylimidazole and 187.6 g of water are placed in a reactor and heated to 80° C. A solution of 1.2 g of azobis (amidinopropane)hydrochloride and 10 g of water is then added dropwise over 90 minutes. After a 4 hour afterpolymerisation, the polymer is precipitated in acetone and dried. A 20% aqueous solution of the polymer is then prepared which substantially contains units of formulae

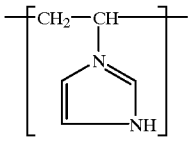

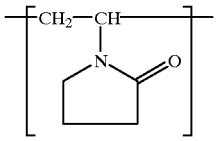

and

-continued

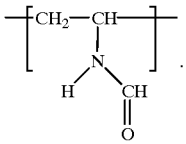

Example 31

147 g of the polymer obtained in accordance with Example 30 and 21 g of 37% HCl are placed in a reactor and then hydrolysed for 5 hours at 95° C. The polymer is precipitated in ethanol and dried. A 20% aqueous solution of the polymer is then prepared which substantially contains units of formulae

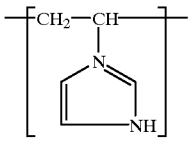

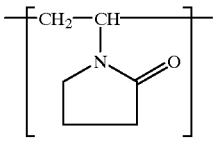

and

-continued

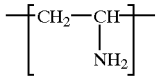

and which is obtained as hydrochloride.

USE EXAMPLES

Example 32

Two 20 g pieces of a bleached cotton tricot are dyed at a liquor ratio of 1:30 by an exhaust process, first wetting the cotton tricot with water and then placing it in a liquor of 40° C. comprising 0.3 g of the dye of formula

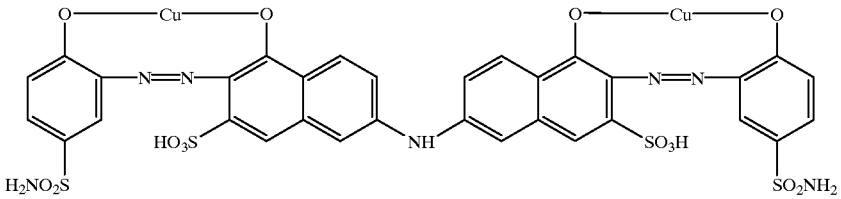

and 20 g/l of calc. Glauber's salt. After heating the liquor at 1° C./min to 98° C., dyeing is carried out for 60 minutes at this temperature, and then the temperature is cooled to 70° C. The dyed material is taken out of the liquor and rinsed for 5 minutes under cold running water.

One of the two dyed cotton tricot pieces is then treated for 30 minutes at 40° C. and at a liquor ratio of 1:30 with a fresh aqueous liquor comprising 1% by weight, based on the weight of the textile material, of the polymer of Example 1 (based on 100% of active substance) and which is adjusted to pH 6 with acetic acid. The dyeing aftertreated in this manner is dehydrated without rinsing and then dried.

Comparison of the aftertreated cotton tricot with the non-aftertreated cotton tricot shows that the aftertreated tricot has a substantially improved fastness to washing.

The above procedure is repeated, but replacing the polymer of Example 1 with 1% by weight, based on the textile material, of one of the polymers of Examples 2 to 31, which also gives a cotton tricot having improved fastness to washing.

Example 33

20 g of non-mercerised cotton cretonne is padded by a cold pad-batch process with an aqueous dye liquor comprising 30 g/l of the dye of formula

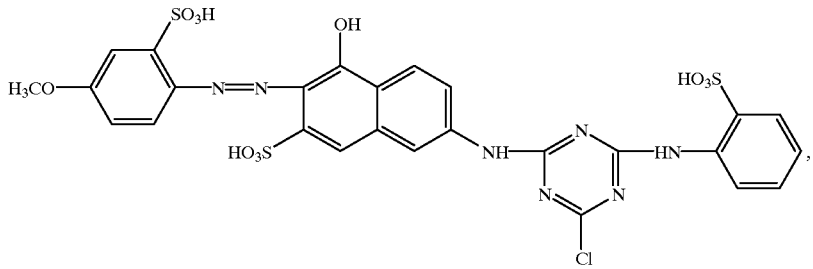

10 g/l of calc. sodium carbonate and 5 ml/l of 30% sodium hydroxide solution (80% liquor pick-up). After storing this material for 6 hours at room temperature, the non-fixed dye is removed by repeated rinsing and washing.

The dyed cotton fabric is then treated for 30 minutes at 40° C. and at a liquor ratio of 1:30 with a fresh aqueous liquor which comprises 1% by weight, based on the weight of the textile material, of the polymer of Example 1 (based on 100% of active substance) and which is adjusted to pH 6 with acetic acid. The dyeing aftertreated in this manner is dehydrated without rinsing and then dried. Compared to the non-aftertreated cotton fabric, the aftertreated cotton fabric has a substantially improved fastness to washing.

The above procedure is repeated, but replacing the polymer of Example 1 with 1% by weight, based on the textile material, of one of the polymers of one of the Examples 2 to 31, also giving a cotton tricot having improved fastness to washing.

The above procedure is repeated, but using instead of 1% by weight 2% by weight of one of the polymers of Example 1 to 31, in each case based on the textile material, giving a cotton tricot having an even further improved fastness to washing.

What is claimed is:

1. A process for fixing reactive or substantive dyes on cellulosic fibre material, which process comprises treating the fibre before, during or after dyeing in a temperature range from 20 to 70° C. with a liquor comprising a homo- or copolymer containing repeating structures of formula (1a)

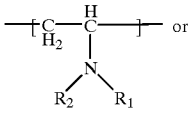

(1b)

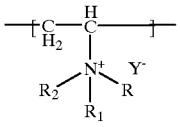

wherein $R_1$ is $C_1$–$C_{12}$alkyl which is unsubstituted or substituted by hydroxy, carboxy, cyano, carbamoyl, a radical —CONH—(alk)—T, N,N-di-$C_1$–$C_4$alkylcarbamoyl, aminophenylsulfonyl, amino or radical —$NHR_3$, —$N(R_3)_2$, —$N(R_3)_3^+Y^-$, —COO—(alk)—T or

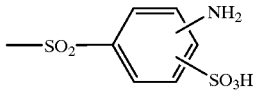

T is hydrogen or a radical —$NH_2$, —$NHR_3$, —$N(R_3)_2$, —$N(R_3)_3^+Y^-$, $R_3$ is $C_1$–$C_8$alkyl, $Y^-$ is an anion, (alk) is a straight-chain or branched $C_1$–$C_{10}$alkylene radical, and R and $R_2$ are each independently of the other hydrogen or benzyl or independently have one of the meanings given above for $R_1$, or a copolymer containing repeating structures of formula (2)

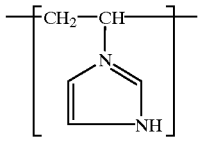

which is obtained by polymerising 80 to 20 mol % of vinylimidazole and 20 to 80 mol % of N-vinylformamide or N-vinylpyrrolidone, or by polymerising N-vinylimidazole, N-vinylpyrrolidone and N-vinylformamide, and where required, with subsequent hydrolysis, or mixtures thereof.

2. A process according to claim 1, which comprises treating the fibre material after dyeing.

3. A process according to claim 1, wherein R and $R_2$ in formulae (1a) and (1b) are each independently of the other hydrogen or $C_1$–$C_4$alkyl.

4. A process according to claim 1, wherein $R_1$ in formulae (1a) and (1b) is a $C_1$–$C_6$alkyl radical which is unsubstituted or substituted by hydroxy, cyano, carbamoyl, a radical —CONH—(alk)—T, N,N-di-$C_1$–$C_4$alkylcarbamoyl, p-aminophenylsulfonyl, amino or a radical —$NHR_3$, —$N(R_3)_2$, —$N(R_3)_3^+Y^-$ or —COO—(alk)—T, wherein (alk) is $C_1$–$C_4$alkylene, $R_3$ is $C_1$–$C_4$alkyl, $Y^-$ is a halide anion and T is hydrogen, amino, N-mono- or N,N-di-$C_1$–$C_4$alkylamino, or a N,N,N-tri-$C_1$–$C_4$alkylammonium halide.

5. A process according to claim 1, wherein $R_1$ in formulae (1a) and (1b) is a $C_1$–$C_4$alkyl radical which is unsubstituted or substituted by hydroxy, cyano, amino, N-mono- or N,N-di-$C_1$–$C_2$alkylamino, N,N,N-tri-$C_1$–$C_2$alkylammonium halide or a radical —CONH—$(CH_2)_{1-3}$—$N(R_3)_2$ or —COO—$(CH_2)_{1-3}$—$N(R_3)_2$, wherein $R_3$ is methyl or ethyl.

6. A process according to claim 1, wherein $R_1$ in formulae (1a) and (1b) is $C_1$–$C_2$alkyl, hydroxy-$C_1$–$C_2$alkyl, cyano- $C_1$–$C_3$alkyl, N,N-di-$C_1$–$C_2$alkylamino-$C_1$–$C_3$alkyl, or a radical of formula $$—CH_2—CH(OH)—(CH_2)_n—T, \quad (3a)$$

$$—CH_2—CH(R_4)—COO—(CH_2)_m—T, \quad (3b) \text{ or}$$

$$—CH_2—CH(R_4)—CONH—(CH_2)_m—T \quad (3c),$$

wherein $R_4$ is hydrogen or methyl, n is 1 or 2, and m is a number from 1 to 3, and T is N,N-di-$C_1$–$C_2$alkylamino or a radical $—N(R_3)_3^+Y^-$, wherein $R_3$ is methyl or ethyl, and $Y^-$ is the bromide or chloride anion.

7. A process according to claim 1, wherein the homo- or copolymer is a homopolymer containing repeating units of the formula (1a) or (1b) claimed in claim 1.

8. A process according to claim 1, wherein the homo- or copolymer is a copolymer which is obtainable by polymerising 80 to 20 mol % of N-vinylimidazole and 20 to 80 mol % of a compound of formula

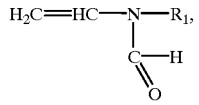

wherein $R_1$ has the meaning claimed in claim 1, with subsequent hydrolysis.

9. A process according to claim 1, wherein the homo- or copolymer has an average molecular weight of 1,000 to 200,000.

10. A process according to claim 1, wherein the homo- or copolymer is present in the liquor in an amount of 0.2 to 4% by weight of active content, based on the weight of the cellulosic fibre material.

11. A process according to claim 1, wherein treatment with the liquor comprising the homo- or copolymer is carried out by an exhaust process.

* * * * *